US009309760B2

(12) United States Patent
Haci et al.

(10) Patent No.: US 9,309,760 B2
(45) Date of Patent: Apr. 12, 2016

(54) AUTOMATED DIRECTIONAL DRILLING SYSTEM AND METHOD USING STEERABLE MOTORS

(71) Applicant: Schlumberger Technology Corporation, Sugar Land, TX (US)

(72) Inventors: Marc Haci, Houston, TX (US); Eric E. Maidla, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 474 days.

(21) Appl. No.: 13/719,003

(22) Filed: Dec. 18, 2012

(65) Prior Publication Data

US 2014/0166363 A1 Jun. 19, 2014

(51) Int. Cl.

| | |
|---|---|
| ***E21B 44/00*** | (2006.01) |
| ***E21B 7/04*** | (2006.01) |
| ***E21B 7/06*** | (2006.01) |
| ***E21B 47/024*** | (2006.01) |
| ***E21B 7/10*** | (2006.01) |

(52) U.S. Cl.

CPC . *E21B 44/00* (2013.01); *E21B 7/04* (2013.01); *E21B 7/068* (2013.01); *E21B 7/10* (2013.01); *E21B 47/024* (2013.01)

(58) Field of Classification Search

None

See application file for complete search history.

(56) References Cited

U.S. PATENT DOCUMENTS

| | | | | |
|---|---|---|---|---|
| 6,050,348 | A | 4/2000 | Richarson et al. | |
| 6,802,378 | B2 | 10/2004 | Haci et al. | |
| 6,837,315 | B2 | 1/2005 | Pisoni et al. | |
| 6,918,453 | B2 | 7/2005 | Haci et al. | |
| 7,059,427 | B2 | 6/2006 | Power et al. | |
| 7,096,979 | B2 | 8/2006 | Haci et al. | |
| 7,810,584 | B2 | 10/2010 | Haci et al. | |
| 8,534,354 | B2 | 9/2013 | Maidla et al. | |
| 9,145,768 | B2 | 9/2015 | Normore et al. | |
| 2004/0118612 | A1 | 6/2004 | Haci et al. | |
| 2004/0222023 | A1 * | 11/2004 | Haci et al. | 175/61 |
| 2006/0081399 | A1 | 4/2006 | Jones | |
| 2006/0266553 | A1 | 11/2006 | Hutchinson | |
| 2008/0066958 | A1 * | 3/2008 | Haci et al. | 175/27 |
| 2008/0164025 | A1 | 7/2008 | Peter | |
| 2010/0193246 | A1 | 8/2010 | Grayson et al. | |
| 2011/0024187 | A1 | 2/2011 | Boone et al. | |

FOREIGN PATENT DOCUMENTS

| | | | |
|---|---|---|---|
| WO | 2012080819 | A2 | 6/2012 |
| WO | WO 2013000094 | A1 * | 1/2013 |
| WO | 2015065883 | A1 | 5/2015 |

OTHER PUBLICATIONS

International Search Report and Written Opinion issued in PCT/US2013/072125 on Nov. 27, 2013, 10 pages.

* cited by examiner

*Primary Examiner* — Jennifer H Gay
*Assistant Examiner* — Caroline Butcher
(74) *Attorney, Agent, or Firm* — Kimberly Ballew

(57) ABSTRACT

A method for directional drilling of a wellbore includes automatically rotating a drill string having a steerable drilling motor at an end thereof in a first direction so that a measured torque related parameter thereon reaches a first value. The drill string is automatically rotated in a second direction so that the measured torque related parameter reaches a second value lower than the first value. A rate of release of the drill string is automatically controlled so that at least one of selected drilling fluid pressure and a range thereof is maintained.

21 Claims, 3 Drawing Sheets

AUTOMATED DIRECTIONAL DRILLING SYSTEM AND METHOD USING STEERABLE MOTORS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to the field of directional drilling using steerable drilling motors. More specifically, the disclosure relates to methods and apparatus for automatically operating a drilling unit to cause a wellbore being drilled with a drill string using a steerable drilling motor to follow a selected trajectory.

Steerable drilling motors are used in directional drilling operations to cause a wellbore drilled through subsurface formations to follow a selected trajectory. To cause the trajectory to remain on a particular direction, the drill string may be rotated from the surface, causing the steerable motor housing to rotate therewith. Such rotation causes the drill string to drill the wellbore along a substantially continuous direction. To change the direction of the wellbore trajectory, the rotation of the drill string at the surface is stopped, and drilling progresses using only the rotation of a drill bit at the lower end of the drill string provided by the steerable motor. The motor may be operated, for example, by flow of drilling fluid therethrough. The drilling motor may have a bend in its housing, such that when rotation of the drill string is stopped, the wellbore trajectory turns in the direction of the inside of the bend in the motor housing. Such procedure is known as "slide" drilling, and may continue until wellbore survey information, such as may be obtained by a measurement while drilling (MWD) instrument disposed in the drill string, indicates that the wellbore trajectory has been reoriented to a new selected direction. At such time, rotation of the drill string may resume (so-called "rotary drilling").

Various techniques are known in the art for improving performance of directional drilling operations using steerable drilling motors. See, for example, U.S. Pat. Nos. 6,802,378, 6,918,453, 7,096,979 and 7,810,584 all of which are issued to Haci et al. The techniques described in the foregoing patents include devices and methods for "rocking" the drill string during slide drilling and methods for changing from slide drilling to rotary drilling and back again, among other things.

What is needed is a method and system for automating the transition from rotary to slide drilling, maintaining a selected direction of the steerable drilling motor during slide drilling and operating the drill string to reduce incidence of "stalling" of the drilling motor by application of excessive axial loading thereon.

SUMMARY

One aspect is a method for directional drilling of a wellbore including automatically rotating a drill string having a steerable drilling motor at an end thereof in a first direction so that a measured torque related parameter thereon reaches a first value. The drill string is automatically rotated in a second direction so that the measured torque related parameter reaches a second value lower than the first value. A rate of release of the drill string is automatically controlled so that at least one of selected drilling fluid pressure and a range thereof is maintained.

Other aspects and advantages of the invention will be apparent from the description and claims which follow.

DETAILED DESCRIPTION

Figure 1:
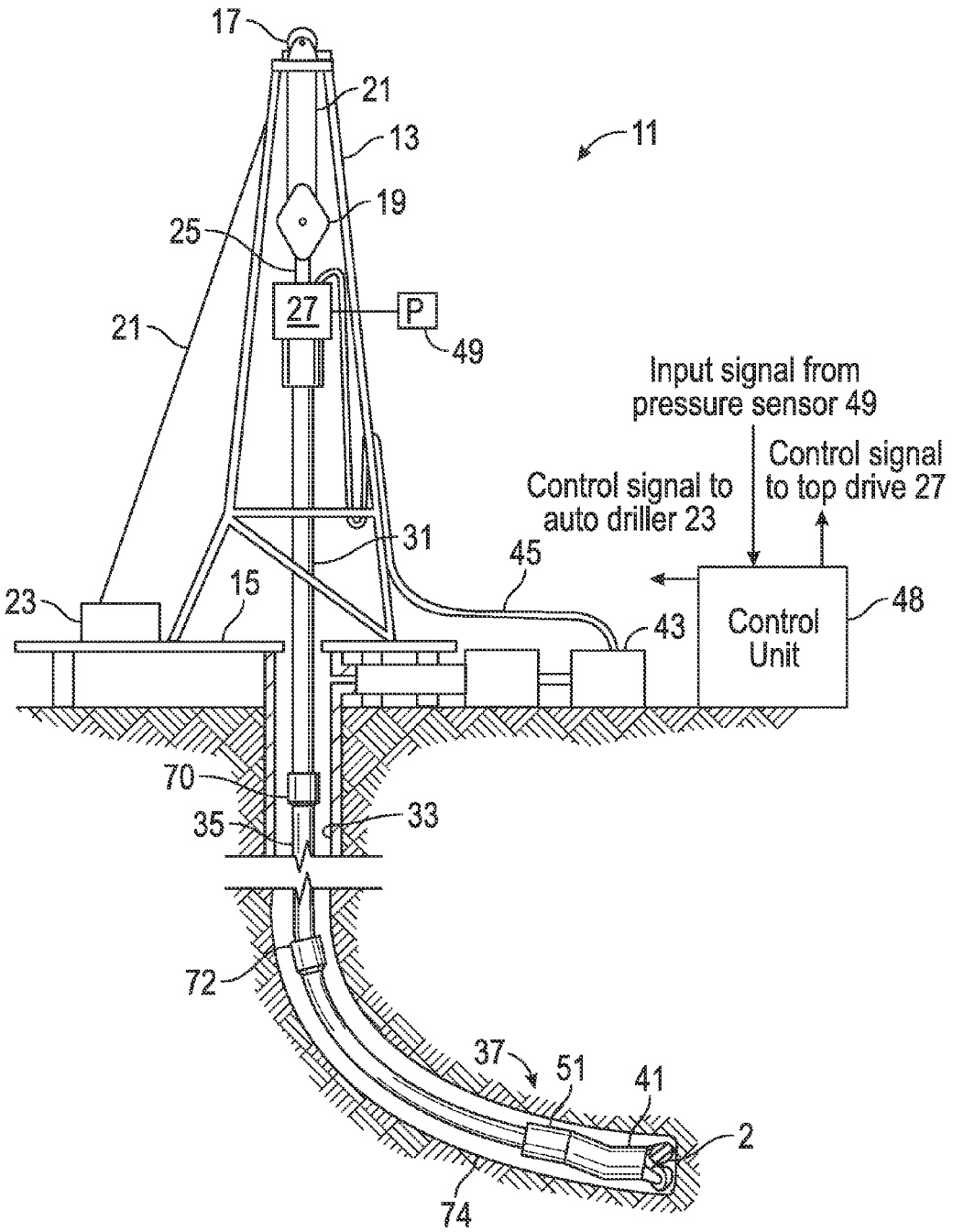
FIG. 1 is a pictorial view of a wellbore drilling system.

In FIG. 1, a drilling unit or "drilling rig" is designated generally at 11. The drilling rig 11 in FIG. 1 is shown as a land-based drilling rig. However, as will be apparent to those skilled in the art, the examples described herein will find equal application on marine drilling rigs, such as jack-up rigs, semisubmersibles, drill ships, and the like.

The drilling rig 11 includes a derrick 13 that is supported on the ground above a rig floor 15. The drilling rig 11 includes lifting gear, which includes a crown block 17 mounted to derrick 13 and a traveling block 19. The crown block 17 and the traveling block 19 are interconnected by a cable 21 that is driven by draw works 23 to control the upward and downward movement of the traveling block 19. The draw works 23 may be configured to be automatically operated to control rate of drop or release of the drill string into the wellbore during drilling. One non-limiting example of an automated draw works release control system is described in U.S. Pat. No. 7,059,427 issued to Power et al. and incorporated herein by reference.

The traveling block 19 carries a hook 25 from which is suspended a top drive 27. The top drive 27 supports a drill string, designated generally by the numeral 31, in a wellbore 33. According to an example implementation, the drill string 31 may in signal communication with and mechanically coupled to the top drive 27 through an instrumented sub 29. As will be described in more detail, the instrumented top sub 29 may include sensors (not shown separately) that provide drill string torque information. Other types of torque sensors may be used in other examples, or proxy measurements for torque applied to the drill string 31 by the top drive 27 may be used, non-limiting examples of which may include electric current (or related measure corresponding to power or energy) or hydraulic fluid flow drawn by a motor (not shown) in the top drive. A longitudinal end of the drill string 31 includes a drill bit 2 mounted thereon to drill the formations to extend (drill) the wellbore 33.

The top drive 27 can be operated to rotate the drill string 31 in either direction, as will be further explained. A load sensor 26 may be coupled to the hook 25 in order to measure the weight load on the hook 25. Such weight load may be related to the weight of the drill string 31, friction between the drill string 31 and the wellbore 33 wall and an amount of the weight of the drill string 31 that is applied to the drill bit 2 to drill the formations to extend the wellbore 33.

The drill string 31 may include a plurality of interconnected sections of drill pipe 35 a bottom hole assembly (BHA) 37, which may include stabilizers, drill collars, and a suite of measurement while drilling (MWD) and or logging while drilling (LWD) instruments, shown generally at 51.

A steerable drilling motor 41 may be connected proximate the bottom of BHA 37. The steerable drilling motor 41 may be any type known in the art for rotating the drill bit 2 and/or selected portions of the drill string 31 and to enable change in trajectory of the wellbore during slide drilling (explained in the Background section herein) or to perform rotary drilling (also explained in the Background section herein). Example types of drilling motors include, without limitation, positive displacement fluid operated motors, turbine fluid operated motors, electric motors and hydraulic fluid operated motors. The present example motor 41 may be operated by drilling fluid flow. Drilling fluid may be delivered to the drill string 31 by mud pumps 43 through a mud hose 45. In some examples, pressure of the drilling mud may be measured by a pressure sensor 49. During drilling, the drill string 31 is rotated within the wellbore 33 by the top drive 27, in a manner to be explained further below. As is known in the art, the top drive 27 is slidingly mounted on parallel vertically extending rails (not shown) to resist rotation as torque is applied to the drill string 31. During drilling, the bit 2 may be rotated by the motor 41, which in the present example may be operated by the flow of drilling fluid supplied by the mud pumps 43. Although a top drive rig is illustrated, those skilled in the art will recognize that the present example may also be used in connection with systems in which a rotary table and kelly are used to apply torque to the drill string 31. Drill cuttings produced as the bit 2 drills into the subsurface formations to extend the wellbore 33 are carried out of the wellbore 33 by the drilling mud as it passes through nozzles, jets or courses (none shown) in the drill bit 2.

Signals from the pressure sensor 49, the hookload sensor 26, the instrumented top sub 29 and from an MWD/LWD system or steering tool 51 (which may be communicated using any known wellbore to surface communication system), may be received in a control unit 48, which will be further explained with reference to FIG. 2.

Figure 2:
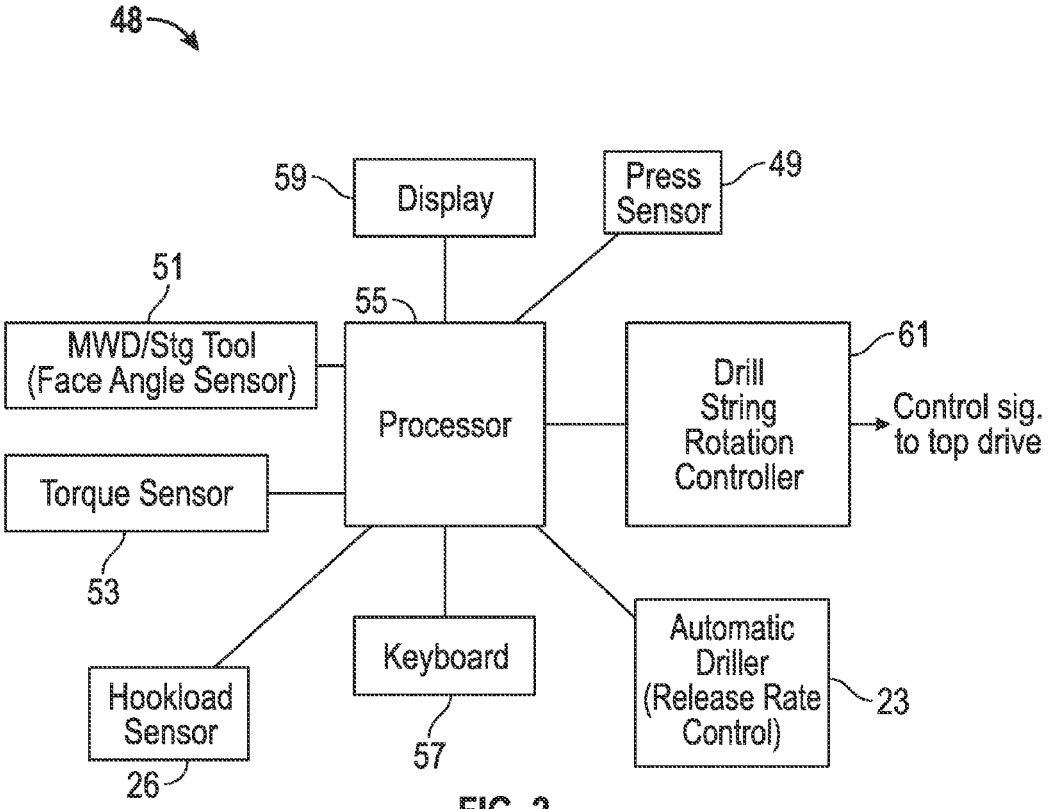
FIG. 2 is a block diagram of an example pipe rotation control system.

FIG. 2 shows a block diagram of the functional components of an example of the control unit 48. The control unit 48 may include a drill string rotation control system. Such system may include a torque related parameter sensor 53. The torque related parameter sensor 53 may provide a measure of the torque (or related measurement as explained above) applied to the drill string (31 in FIG. 1) at the surface by the top drive or kelly. The torque related parameter sensor 53 may be implemented, for example, as a strain gage in the instrumented top sub (29 in FIG. 1) if it is configured to measure torque. The torque related parameter sensor 53, as explained above may also be implemented, for example and without limitation, as a current measurement device for an electric rotary table or top drive motor, as a pressure sensor for an hydraulically operated top drive, or as an angle of rotation sensor for measuring drill string rotation. In principle, the torque related parameter sensor 53 may be any sensor that measures a parameter that can be directly or indirectly related to the amount of torque applied to the drill string.

The output of the torque related parameter sensor 53 may be received as input to a processor 55. In some examples, output of the pressure sensor 49 and/or one or more sensors of the MWD/LWD system or steering tool 51 may also be provided as input to the processor 55. A particular input from the MWD/LWD system or steering tool 51 may be the orientation angle with respect to geomagnetic or geodetic direction and Earth's gravity of a bend in the housing of the steerable drilling motor (41 in FIG. 1). The foregoing may be referred to as "toolface angle", or "toolaface." Toolface angle may be measured with reference to geomagnetic or geodetic direction when the wellbore is inclined from vertical below a selected threshold inclination angle, as a non-limiting example five degrees. Above the threshold wellbore inclination angle, the toolface may be measured with reference to the uppermost surface of the wellbore, known as "high side" toolface.

The processor 55 may be any programmable general purpose processor such as a programmable logic controller (PLC) or may be one or more general purpose programmable computers. The processor 55 may receive user input from user input devices, such as a keyboard 57. Other user input devices such as touch screens, keypads, and the like may also be used. The processor 55 may also provide visual output to a display 59. The processor 55 may also provide output to a drill string rotation controller 61 that operates the top drive (27 in FIG. 1) or rotary table (FIG. 3) to rotate the drill string as will be further explained below.

The drill string rotation controller 61 may be implemented, for example, as a servo panel (not shown separately) that attaches to a manual control panel for the top drive. One such servo panel is provided with a service sold under the service mark SLIDER, which is a service mark of Schlumberger Technology Corporation, Sugar Land, Tex. The drill string rotation controller 61 may also be implemented as direct control to the top drive motor power input (e.g., as electric current controls or variable orifice hydraulic valves). The top drive control can also be implemented as computer code in the control unit 48 to operate the top drive controller 27. The type of drill string rotation controller is not a limit on the scope of the present disclosure.

The processor 55 may also accept as input signals from the hookload sensor 26. The processor may also provide output signals to the automated draw works 23 as explained with reference to FIG. 1.

Figure 3:
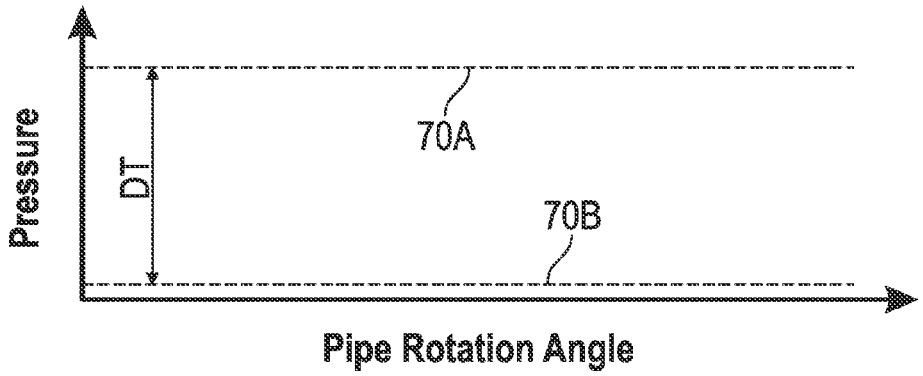
FIG. 3 shows a graph of on bottom drilling mud pressure compared with off bottom mud pressure.

Referring once again to FIG. 1, an example "directional" wellbore, that is, one that is drilled along a selected trajectory other than vertical, may be initially drilled as a vertical wellbore, shown at 70. During this part of the drilling operation, the draw works 23 are released to enable some of the weight of the drill string 35 to be transferred to the drill bit 2. During this part of the drilling operation, the drill string 35 may be rotated to maintain the trajectory of the wellbore substantially along a vertical path. Signals from the pressure sensor 49 may be conducted to the control unit 48 which in turn may operate the draw works as explained with reference to FIG. 2 so that the measured pressure does not exceed a value associated with "stalling" of the steerable drilling motor. Referring briefly to FIG. 3, a pressure measured by the pressure sensor (49 in FIG. 1) when the bit 2 is on bottom drilling (e.g., in rotary drilling mode) is indicated by 70A and reflects the increase in pressure caused by pressure drop across the steerable drilling motor 41. The pressure shown at 70A may be close to the maximum pressure drop that may be applied across the steerable drilling motor without stalling. 70B shows an example measured pressure when the drill bit 2 is not on the bottom of the wellbore, i.e., the steerable drilling motor is operating but is exerting no drilling torque. During this part of the drilling operation, the control unit 48 may operate the draw works 23 to maintain the measured pressure close to the value shown at 70A so that the rate at which the wellbore is axially lengthened (called rate of penetration or "ROP") is optimized, or the pressure may be maintained within a selected optimal range. Difference between the off bottom rotating pressure 70B and the on bottom drilling pressure 70A may correspond to a difference between drilling torque and free rotating torque, shown as DT.

Figure 4:
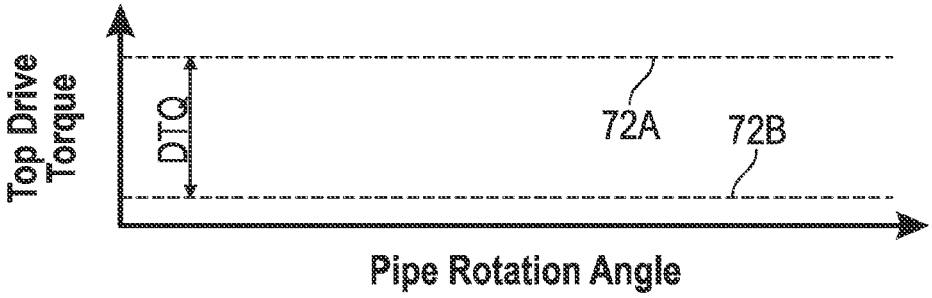
FIG. 4 shows a graph of applied torque from a top drive with respect to pipe rotation angle.

As the wellbore trajectory is changed to begin inclination from vertical, as shown at 72 in FIG. 1, the drill string rotation will be stopped, and measurements from the MWD and or steering tool 51 will cause the control unit 48 to operate the top drive 27 such that the steerable drilling motor 41 is oriented in the selected direction. FIG. 4 shows a graph of the amount of torque, at 72A, held by the top drive in response to reactive torque exerted by the drilling motor (41 in FIG. 1) when it is on bottom in slide drilling mode. 72B shows the amount of torque restrained by the top drive when the bit is off bottom and the reactive torque from the drilling motor is much lower. The difference between drilling torque at 72A and off bottom torque 72B is shown as DTQ. During this portion of the drilling operation, there is relatively little frictional torque resulting from contact between the drill string (35 in FIG. 1) and the wellbore wall.

Referring once again to FIG. 1, as directional drilling progresses so that there is more and more contact between the drill string and the wellbore, as shown at 74, the amount of friction applied to the drill string increases correspondingly. Such friction may be manifested by a reduction in the amount of reactive torque transmitted from the drilling motor 41 to the top drive 27 and a reduction in the amount of axial force of the drill string transmitted to the top drive as measured by the hook load sensor 26.

In one example, a calibration may be performed so that a relationship between combined torque exerted by the directional drilling motor 41 and the drill string, and the drilling fluid pressure may be determined. Also, a relationship between the hookload and the drilling fluid pressure may be determined. In one example, the drilling fluid pressure and hookload are measured while the drill string is rotating (so that drill string friction effects are accounted for). The resulting determined relationships may be used in the control unit 48, e.g., in the processor 55 to determine suitable rocking torque values and hookload values.

Referring once again to FIG. 2, according to one example, the processor 55 may operate the drill string rotation controller 61 to cause the top drive (27 in FIG. 1) or kelly (4 in FIG. 2) to rotate the drill string (31 in FIG. 1) in a first direction, while measuring the drill string torque related parameter using the torque related parameter sensor 53. The rotation controller 61 continues to cause the top drive or kelly to rotate the drill string (31 in FIG. 1) in the first direction until a first selected value of the torque related parameter is reached. When the processor 55 registers the torque related parameter magnitude measured by torque related parameter sensor 53 as having reached the first selected value, the processor 55 actuates drill string rotation controller 61 to cause the top drive or kelly to reverse the direction of rotation of the drill string (31 in FIG. 1) until a second selected torque related parameter value is reached. As drilling progresses, the processor 55 continues to accept as input measurements from the torque related parameter sensor 53 and actuates the rotation controller 61 to cause rotation of drill string (31 in FIG. 1) back and forth between the first selected parameter value and the second selected parameter value. At the same time, measurements from the pressure sensor 49 may be used as input by the controller 55 to operate the draw works 23 so as to maintain the drilling fluid pressure within a selected operating range or at a selected operating value.

In some examples, the amount of torque in the first and second direction may be selected so that a position of the drill string at a midpoint of the first and second torque values maintains a selected rotational position at the surface (called a "scribe mark"). If it is observed that the midpoint (scribe mark) changes rotational orientation in one direction or the other, the torque exerted during rocking in the first or the second direction may be adjusted to either maintain the moved scribe mark orientation or to return the scribe mark to its previous position.

As drilling progresses, the amount of friction applied to the drill string will increase corresponding to the amount of contact between the wellbore wall and the drill string. The foregoing is related to the inclination of the wellbore, the rate of change of inclination and the length of the inclined sections of the wellbore. Therefore, as such drilling progresses, there is less correspondence between the measured hookload (art sensor 26 in FIG. 1) and the amount of axial force applied to the drill bit (2 in FIG. 1) and less reactive torque from the drilling motor is transmitted to the top drive. At a certain point, as the drill string friction increases, essentially all the reactive torque will be absorbed by the friction and substantially no reactive torque will be transmitted to the top drive. The foregoing "rocking" procedure may be implemented to break some of the friction without causing the toolface to move.

Figure 5:
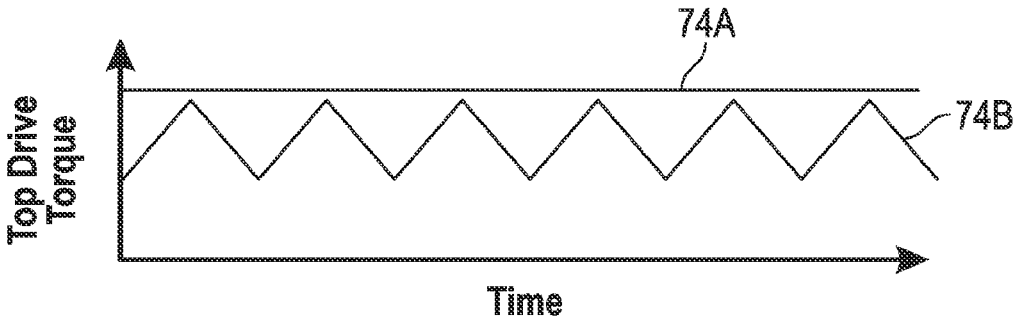
FIG. 5 shows a graph of torque applied by the top drive with respect to time to illustrate pipe rocking

Referring to FIG. 5, a graph of torque applied by the top drive to the drill string with respect to time is shown. An upper torque limit in the ordinary direction of rotation of the drill string during rotary drilling (a first torque value in a first direction) is shown at 74A, but it should be understood that the torque shown at 74A occurs during the rocking procedure that is performed during slide drilling. The torque applied to the drill string by the top drive is shown by curve 74B. A lowermost value of the torque, resulting from rotating the drill string in the opposite direction to the first direction is shown at the lower peaks of curve 74B. It should be understood that depending on the calibration results as explained above, the lower peaks 74B may occur at a lower value of torque in the ordinary direction or rotation, or may occur at some value of torque in a direction opposite to the ordinary direction of rotation of the drill string. At the same time as the pipe is rocked as shown in FIG. 5, the control unit (48 in FIG. 2) operating under control of the processor (55 in FIG. 2) when suitably programmed, may send signals to the automatic driller (23 in FIG. 1) release the drill string at a rate selected to maintain a drilling mud pressure proximate a limit as explained with reference to FIGS. 3 and 4.

During building of the inclination (e.g., at 72 in FIG. 1), an initial amount of rocking torque variation, i.e., a difference between the upper limit 74A and the bottoms of curve 74B may be selected based on a predetermined fraction of the difference DTQ between the "off bottom" torque (e.g., at 72B in FIG. 4) and the "on bottom" or drilling torque (e.g., at 72A in FIG. 4). The predetermined fraction may be, for example between about 2 and 40 percent of DTQ. The fraction may be selected so that the toolface indicated by the MWD tool or steering tool substantially does not change value from its selected value. The processor (55 in FIG. 2) may be programmed to reduce the rocking torque variation if the toolface measurements are determined to vary corresponding to the rocking motion of the drill string. To the extent the toolface has moved, the rocking torque may be momentarily increased in the first direction or decreased in the second direction (or if the second direction torque is in the opposite direction to increase in such second direction) to move the toolface to its selected orientation.

The processor (55 in FIG. 2) may also be programmed to operate the draw works automatically such that a rate of release of the drill string is decreased until the toolface orientation measurements no longer are responsive to changes in rocking torque. At such point, the controller may be programmed to increase the rate of release of the drill string until the toolface orientation changes if the rocking torque exceeds a value related to the amount of friction on the drill string and the drilling mud pressure is at most equal to the upper limit explained with reference to FIG. 4. If the rate of release of the drill string is too high, small changes in the amount of rocking torque variation will be manifested in changes in the measured toolface orientation, and the drilling mud pressure will be closer to the lower limit explained with reference to FIG. 3. In such case, the controller may be programmed to decrease the rate of release of the drill string such that the correct drilling mud pressure is attained as explained with reference to FIG. 4 and there is only insubstantial change in measured toolface orientation with respect to changes in rocking torque value.

In one example, an optimized rate of penetration of the drill string (i.e., an optimized rate of release of the drill string) and optimized rocking torque values may be determined in the control unit (48 in FIG. 1), and commands to operate the automatic driller (23 in FIG. 1) and the top drive by using the calibrations of drilling fluid pressure with respect to hookload and motor torque, and corresponding toolface response, determined as explained above all programmed into the processor (55 in FIG. 2).

An automatic directional drilling system and method according to the examples described herein may provide improved drilling efficiency and reduce the amount of user input required, thus reducing the possibility of operator caused error in function of the system.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for directional drilling of a wellbore, comprising:

drilling the wellbore initially substantially vertically while rotating a drill string disposed in the wellbore in a first direction;

stopping rotation of the drill string in the first direction and orienting a toolface of a steerable drilling motor attached to the drill string in a selected direction;

measuring a parameter related to torque exerted on the drill string to maintain the orientation of the toolface first when the steerable drilling motor exerts torque to rotate a drill bit so as to continue drilling the wellbore and second when the steerable drilling motor exerts no torque;

determining a difference between the first measured parameter and the second measured parameter;

setting a first torque value to correspond to the first measured parameter;

setting a second torque value to correspond to the first measured parameter less a predetermined fraction of the difference, the second torque value lower than the first torque value;

automatically rotating the drill string the first direction so that a measured torque related parameter thereon reaches the first torque value;

automatically rotating the drill string in a second direction opposite to the first direction until the measured torque related parameter reaches the second torque value; and automatically controlling a rate of release of the drill string so that a measured pressure of drilling fluid is maintained at a selected pressure or within a selected pressure range.

2. The method of claim 1 further comprising automatically selecting the first torque value and the second torque value such that a measured toolface orientation of the steerable drilling motor substantially does not change.

3. The method of claim 2 further comprising automatically changing the first and second torque values when the measured toolface orientation changes.

4. The method of claim 1 further comprising automatically controlling the rate of release of the drill string so that a measured toolface orientation of the steerable drilling motor substantially does not change.

5. The method of claim 4 further comprising changing the rate of release of the drill string when changes in the first torque value and the second torque value result in changes in the toolface orientation.

6. The method of claim 1 further comprising:

increasing the first torque value and the second torque value as an amount of friction between the drill string and a wall of the wellbore is increased.

7. The method of claim 6 further comprising automatically controlling the rate of release of the drill string so that the toolface orientation of the steerable drilling motor substantially does not change.

8. The method of claim 7 further comprising automatically changing the rate of release of the drill string when changes in the first torque value and the second torque value result in changes in the toolface orientation.

9. The method of claim 7 further comprising automatically changing the rate of release of the drill string when changes in the first torque value and the second torque value result in no changes in the toolface orientation.

10. The method of claim 1 wherein the first torque value and the second torque value are selected such that a midpoint between the first torque value and at the second torque value maintains a substantially constant drill string rotational orientation at the surface.

11. A system for directional drilling using a steerable drilling motor, comprising:

at least one sensor for measuring a parameter related to torque applied to a drill string wherein the steerable drilling motor comprises a part of the drill string;

a control unit having a processor therein in signal communication with the at least one sensor;

means for rotating the drill string to at least one selected value of the torque related parameter in signal communication with the control unit;

an automatic drilling system configured to control a rate of release of the drill string into a wellbore in signal communication with the control unit; and at least one sensor for measuring pressure of drilling fluid being pumped through the drill string, wherein the processor is programmed to operate the means for rotating in a first direction to automatically drill the wellbore initially substantially vertically while rotating the drill string, the processor programmed to automatically stop rotation of the drill string and orient a toolface of the steerable drilling motor in a selected direction, the processor programmed to automatically set a difference between a first measured torque related parameter value and a second measured torque related parameter value at a predetermined fraction of a difference between a first torque exerted by the rotating drill string that includes the steerable drilling motor drilling with a drill bit on a bottom of the wellbore and a second torque exerted by rotating the drill string with the drill bit off the bottom of the wellbore, the processor programmed to operate the means for rotating in the first direction until the torque related parameter reaches the first value, the processor further programmed to operate the means for rotating in a second direction opposite to the first direction until the torque related parameter reaches the second value, the processor programmed to operate the automatic driller to cause release of the drill string at a rate selected to cause the measured drill string pressure to reach a selected value or remain within a selected range.

12. The system of claim 11 wherein the means for rotating comprises a top drive.

13. The system of claim 11 wherein the processor is programmed to automatically select the first torque related parameter value and the second torque related parameter value such that a measured toolface orientation of the steerable drilling motor substantially does not change.

14. The system of claim 13 wherein the processor is programmed to automatically change the first and second torque related parameter values when the measured toolface orientation changes.

15. The system of claim 11 wherein the processor is programmed to automatically control the rate of release of the drill string so that a measured toolface orientation of the steerable drilling motor substantially does not change.

16. The system of claim 15 wherein the processor is programmed to automatically change the rate of release of the drill string when changes in the first torque related parameter value and the second torque related parameter value result in changes in the toolface orientation.

17. The system of claim 11 wherein the processor is programmed to cause:

automatically increasing the first torque related parameter value and the second torque related parameter value as an amount of friction between the drill string and a wall of the wellbore is increased.

18. The system of claim 17 wherein the processor is programmed to automatically control the rate of release of the drill string so that the toolface orientation of the steerable drilling motor substantially does not change.

19. The system of claim 18 wherein the processor is programmed to automatically change the rate of release of the drill string when changes in the first torque related parameter value and the second torque related parameter value result in changes in the toolface orientation.

20. The system of claim 18 wherein the processor is programmed to automatically change the rate of release of the drill string when changes in the first torque related parameter value and the second torque related parameter value result in no changes in the toolface orientation.

21. The system of claim 11 wherein the processor is programmed to automatically select the first torque related parameter value and the second torque related parameter value such that a midpoint between the first torque related parameter value and at the second torque related parameter value maintains a substantially constant drill string rotational orientation at the surface.

* * * * *